US009943843B2

(12) United States Patent
Baroud et al.

(10) Patent No.: US 9,943,843 B2
(45) Date of Patent: Apr. 17, 2018

(54) MICROFLUIDIC CIRCUIT ALLOWING DROPS OF SEVERAL FLUIDS TO BE BROUGHT INTO CONTACT, AND CORRESPONDING MICROFLUIDIC METHOD

(71) Applicants: ECOLE POLYTECHNIQUE, Palaiseau (FR); CENTRE NATIONAL DE LA RECHERCHE SCIENTIFIQUE, Paris (FR)

(72) Inventors: Charles Baroud, Paris (FR); Paul Abbyad, Santa Clara, CA (US); Etienne Fradet, Arcueil (FR); Rémi Dangla, Paris (FR)

(73) Assignees: ECOLE POLYTECHNIQUE, Palaiseau (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 41 days.

(21) Appl. No.: 14/434,342

(22) PCT Filed: Oct. 8, 2013

(86) PCT No.: PCT/EP2013/070967
§ 371 (c)(1),
(2) Date: Apr. 8, 2015

(87) PCT Pub. No.: WO2014/056931
PCT Pub. Date: Apr. 17, 2014

(65) Prior Publication Data

US 2015/0258543 A1 Sep. 17, 2015

(30) Foreign Application Priority Data

Oct. 8, 2012 (FR) ..... 12 59565

(51) Int. Cl.
*B01L 99/00* (2010.01)
*B01L 3/00* (2006.01)
(Continued)

(52) U.S. Cl.
CPC ..... *B01L 3/5027* (2013.01); *B01F 3/08* (2013.01); *B01F 11/0045* (2013.01);
(Continued)

(58) Field of Classification Search
None
See application file for complete search history.

(56) References Cited

U.S. PATENT DOCUMENTS

2006/0051329 A1 3/2006 Lee et al.
2009/0126516 A1 5/2009 Yamamoto et al.
2013/0078164 A1* 3/2013 Baroud ..... B67D 3/0058 422/502

FOREIGN PATENT DOCUMENTS

EP 2016997 A1 1/2009
FR 2873171 A1 1/2006
(Continued)

OTHER PUBLICATIONS

Nov. 18, 2013 International Search Report issued in International Patent Application No. PCT/EP2013/070967.
(Continued)

*Primary Examiner* — Paul S Hyun
(74) *Attorney, Agent, or Firm* — Oliff PLC

(57) ABSTRACT

The subject of the present invention is a microfluidic circuit in which are defined microchannels able to contain fluids and including at least one device for forming drops of a solution, guiding the drops to a storage zone in which one of the drops can be brought into contact with a drop of another solution, the walls of the microchannel portion forming the first drop-formation device diverging so as to cause drops of
(Continued)

the first solution to detach under the effect of the surface tension of the first solution; the first guide include wall portions of the microchannels that diverge so as to cause the drops to move along under the effect of the surface tension of the first solution.

15 Claims, 8 Drawing Sheets

(51) Int. Cl.

| | |
|---|---|
| ***B01F 11/00*** | (2006.01) |
| ***B01F 11/02*** | (2006.01) |
| ***B01F 13/00*** | (2006.01) |
| ***B01F 13/10*** | (2006.01) |
| ***B01F 3/08*** | (2006.01) |
| *B01F 15/02* | (2006.01) |

(52) U.S. Cl.
CPC ..... *B01F 11/0266* (2013.01); *B01F 13/0071* (2013.01); *B01F 13/0076* (2013.01); *B01F 13/0079* (2013.01); *B01F 13/1016* (2013.01); *B01L 3/502784* (2013.01); *B01F 2015/0221* (2013.01); *B01L 3/502792* (2013.01); *B01L 2200/0673* (2013.01); *B01L 2200/10* (2013.01); *B01L 2200/16* (2013.01); *B01L 2300/089* (2013.01); *B01L 2300/0816* (2013.01); *B01L 2300/0867* (2013.01); *B01L 2400/02* (2013.01); *B01L 2400/0487* (2013.01); *B01L 2400/0688* (2013.01); *B01L 2400/086* (2013.01); *Y10T 137/0318* (2015.04)

(56) References Cited

FOREIGN PATENT DOCUMENTS

| | | | | |
|---|---|---|---|---|
| FR | 2950544 | A1 * | 4/2011 | ..... B01L 3/502784 |
| JP | U3142126 | | 6/2008 | |
| WO | 2007/105584 | A1 | 9/2007 | |
| WO | 2011039475 | A1 | 4/2011 | |
| WO | 2011121220 | A1 | 10/2011 | |

OTHER PUBLICATIONS

Nov. 18, 2013 Written Opinion issued in International Patent Application No. PCT/EP2013/070967.
Baroud et al., "Reaction-diffusion dynamics: confrontation between theory and experiment in a microfluidic reactor," Physical Review, 2003.
Huebner et al., "Monitoring a reaction at submillisecond resolution in picoliter volumes," Analytical Chemistry, Jan. 12, 2011, http://pubs.acs.org/doi/pdf/10.1021/ac103234a.
Sep. 27, 2017 Office Action issued in Japanese Patent Application No. 2015-535063.

* cited by examiner

MICROFLUIDIC CIRCUIT ALLOWING DROPS OF SEVERAL FLUIDS TO BE BROUGHT INTO CONTACT, AND CORRESPONDING MICROFLUIDIC METHOD

1. FIELD OF THE INVENTION

The present invention relates to a microfluidic circuit allowing for the manipulation of very small quantities of fluids. It relates in particular to such a microfluidic circuit that allows several different fluids to be manipulated and brought into contact.

The present invention relates in particular to such a microfluidic circuit allowing small quantities of chemical reagents to be brought into contact to trigger a reaction between them and conduct a kinetic analysis of this reaction.

The invention relates also to a microfluidic method for bringing drops of several fluids into contact.

2. PRIOR ART

"Stop Flow" Methods

Different methods are known to those skilled in the art for analyzing the kinetics of a chemical reaction. One of these methods consists in mixing reagents in a tank and in observing, in the moments following the mixing, the trend of the chemical reaction. The application of this method demands a particularly fast mixing of the reagents, to prevent the chemical reaction from taking place during the mixing phase.

This fast mixing of the components in a tank and the analysis of the progress of the reaction require specialist equipment items, which are costly. Moreover, implementing this method leads to the consumption of a relatively significant quantity of the reagents (generally more than 100 microliters), which may prove costly when one of the reagents is rare or precious or when a series of numerous analyses is necessary. Finally, this method proves ineffective for the observation of very fast reactions, which take place while the reagents are being mixed.

Microfluidic Methods

Another method for analyzing the kinetics of a chemical reaction, also known to those skilled in the art, consists in bringing two reagents into contact without mixing them. The observation of the progress of the chemical reaction in the reagents, in the moments following this contact, makes it possible to calculate the kinetic characteristics of the chemical reaction. These methods may be effective, notably for the observation of reactions with very fast kinetics. However, they are often difficult to implement.

Among the methods for bringing reagents into contact without mixing them, some are microfluidic methods, in which the volumes of reagents brought into contact are very small.

Microfluidic Method for Bringing Flows into Contact

Also known, notably through the article "Reaction—diffusion dynamics: Confrontation between theory and experiment in a microfluidic reactor" by Baroud, Okkels, Ménétrier and Tabeling (Physical Review, E 67 060104(R) (2003)), is a microfluidic method in which two flows of very small volume of reagents are brought into contact without being mixed, which makes it possible to observe the reaction occurring between the reagents.

This method proves, in practice, relatively complex to implement, and exhibits limited reliability and robustness. Moreover, it leads to the consumption of a very significant volume of reagents. Consequently, even though its reliability has been demonstrated experimentally, it has not been implemented on an industrial scale.

Microfluidic Method for Bringing Drops into Contact

Another microfluidic method consists in bringing drops of reagents, of very small volume, into contact with one another, then merging the drops in order to bring the reagents into contact to allow the reaction. Such a method has been described in the article "Monitoring a Reaction at Submillisecond Resolution in picoliter Volumes" by Huebner, Abell, Huck, Baroud and Hollfelder (Analytical Chemistry).

According to this method, drops of a first reagent, borne by a flow of carrier fluid, are sent into traps formed in a microfluidic circuit. Subsequently, drops of a second reagent are sent by the flow of carrier fluid to the same traps, so as to bring together, in one and the same trap, a drop of each of the two reagents. It is then possible, by known means, to merge the two drops in contact with one another in the trap to bring the two reagents into contact and provoke the reaction.

However, this method proves relatively complex to implement and requires particular conditions to obtain reliable results. Moreover, it also leads to a consumption of reagents greater than is necessary.

3. OBJECTIVE OF THE INVENTION

The objective of the present invention is to mitigate these drawbacks of the prior art.

In particular, the objective of the present invention is to propose a method that makes it possible to bring different fluids into contact which may be controlled and observed effectively, for example to obtain a reaction between them and allow an analysis of the kinetics of this reaction.

Another objective of the invention is to propose such a method which is more reliable, simpler and less costly to implement than the reaction kinetics analysis methods of the prior art.

Another objective of the invention is to propose such a method which leads to the consumption of a particularly small quantity of the fluids intended to react.

4. EXPLANATION OF THE INVENTION

These objectives, and others which will become more clearly apparent hereinbelow, are achieved using a microfluidic circuit, in which are defined microchannels containing fluids, the circuit comprising at least:

- one first device for forming drops of a first solution in a carrier fluid, comprising a microchannel portion passed through by the first solution;
- first means for guiding said drops to a storage area in which one of the drops may be brought into contact with a drop of a second solution.

According to the invention, the walls of the microchannel portion of the first drop forming device diverge so as to detach drops of the first solution under the effect of the surface tension of the first solution; and in that the first guiding means comprise portions of wall of the microchannels, diverging so as to displace the drops under the effect of the surface tension of the first solution.

Thus, the walls of the microchannel in which the fluid flows diverge, that is to say that the fluid flowing in this microchannel passes, in the course of its flow, from a microchannel portion in which it is subject to a strong confinement to a microchannel portion in which it is subject to a less strong confinement. This reduction of the confinement allows the surface energy of this fluid to decrease during the flow.

For this, the microchannels of the microfluidic circuit are configured for the solution to circulate therein between walls which diverge from one another, causing a variation of the confinement of the solution. The divergence of each wall may be gradual (sloping walls) or abrupt (step). The surface tension of the solution, that is to say the interfacial tension between the solution and the carrier fluid with which it is in contact, imposes on the flow of solution a form that takes account of this variable confinement, which culminates in the separation of drops.

This method for separating drops, in which the surface tension of the solution is used to cause the detachment of the drop, is therefore radically differentiated from the methods requiring a flow of carrier fluid to create a drop by shearing the solution, by opposing the surface tension of the solution which tends, on the contrary, to bring the solution together. It also offers the advantage of not requiring any balancing of a flow of carrier fluid with the flow of solution, which simplifies the method.

The displacement of the drops is also caused by the divergence of the walls coupled with the effects of the surface tension of the drops. The drops may thus be fabricated and transported independently of the presence or absence of a flow of the carrier fluid. The size of the drops, notably, does not greatly depend on a movement of the carrier fluid, and is uniform from the start of their formation. The fabrication and the displacement of the drops are thus more reliable, in as much as they are defined solely by the configuration of the walls of the microchannels, without being disturbed by a flow of carrier fluid. Of course, the carrier fluid, although substantially static, is subject to slight disturbances caused by the displacement of the drops.

The microfluidic circuit of the invention notably makes it possible to bring drops into contact to merge them, which allows for a particularly simple study of the kinetics of the chemical reactions. The device to be implemented is simple and inexpensive and a very small quantity of solution is used to implement this study. Moreover, this study of reaction between two drops in a microfluidic circuit makes it possible to observe reactions with very rapid kinetics between several reagents.

The method is particularly robust, in as much as it is sufficient to fill a circuit of carrier fluid, then inject the solutions, to produce drops of predefined volume and bring them into contact. The different operations may be performed in succession, without them having to be coordinated or balanced.

It should be noted that the method makes the use of surfactant additive in the carrier fluid optional, in as much as the drops are not in contact with another drop before arriving in the trap in which they have to be merged.

According to an advantageous embodiment, the first drop forming device comprises a nozzle passed through by the first solution and emerging in a chamber, the walls of which are further apart than the walls of the nozzle.

Advantageously, in this case, the walls of said chamber diverge from one another on moving away from the nozzle.

Preferably, the walls of said chamber are configured to define said guiding means and said storage area.

According to a preferential embodiment, the storage area consists of an area of one of the microchannels in which a drop may exhibit a lower surface energy than in the neighboring areas.

A drop may thus penetrate into this area, but may no longer exit therefrom without a supplemental energy being conferred thereon, for example by a flow of carrier fluid. It is in effect necessary for its surface energy to be increased for it to go into a contiguous area to the storage area, also called drop trap.

Preferentially, this storage area is divided into at least two contiguous trapping areas that may each receive a drop.

Each of these trapping areas constitutes a storage area, or a drop trap. However, since these trapping areas are contiguous, they require the drops that they contain to be in contact with one another.

Advantageously, this storage area is divided into two substantially circular trapping areas that partially intersect, so as to be in the form of an "8".

This form of storage area makes it possible to bring two drops into contact, by accurately knowing the position of each of the two drops and the position of the contact between these drops. Moreover, when the two drops merge into one, this form of storage area enables the drop resulting from the merging to be of oblong form, allowing for a better observation of the reaction between the content of the two drops. This form of storage area is particularly well suited to the observation of chemical reactions.

According to an advantageous embodiment of the invention, the microfluidic circuit also comprises

- a second device for forming drops of a second solution in the carrier fluid, comprising a microchannel portion passed through by the second solution, and
- second means for guiding the drops of the second solution to the trapping area in which one of said drops of said second solution may be brought into contact with said drop of the first solution.

The walls of said microchannel portion of the second drop forming device diverging so as to detach a drop of the second solution under the effect of the surface tension of the second solution; and said second means for guiding said drops comprising portions of wall of said microchannels, diverging so as to displace the drops of said second solution under the effect of the surface tension of said second solution.

It is thus possible for the two drops which are brought into contact to be both produced in the microfluidic circuit, which simplifies the production and the bringing into contact of the drops.

Advantageously, in this case, the first guiding means are configured to guide the drops of the first solution to a first trapping area of the storage area, and the second guiding means are configured to guide the drops of the second solution to a second trapping area of the storage area.

Advantageously, the first and the second drop forming devices are configured to form drops of different size.

Preferably, in this case, the storage area has at least two trapping areas of different size, one being of a size suitable for receiving a drop formed by the first drop forming device, and the other being of a size suitable for receiving a drop formed by the second drop forming device.

The microfluidic circuit may thus be best adapted to the desired experimentation conditions.

According to an advantageous embodiment, the microfluidic circuit also comprises at least one third device for forming drops of a third solution in the carrier fluid, and means for guiding the drops of the third solution to the storage area.

The microfluidic circuit may thus make it possible to successively observe a number of reactions, between different reagents.

Preferentially, the microfluidic circuit comprises means for discharging the drops situated in the storage area.

A number of reactions may thus be analyzed with the same device at a very high rate.

Advantageously, these discharging means comprise means for producing a flow of carrier fluid suitable for driving said drops out of said storage area.

The invention relates also to a microfluidic circuit in which are defined microchannels suitable for being filled with fluids to form a microfluidic circuit as described above.

The invention relates also to a microfluidic method for bringing two drops of different solutions into contact, characterized in that it comprises at least the following steps, performed simultaneously or in succession:

- introduction of a first solution in microchannels of a microfluidic circuit;
- detachment of a first drop of said first solution in a carrier fluid, caused by the divergence of the walls of said microchannels, coupled with the effects of the surface tension of said first solution;
- displacement of said first drop, caused by the divergence of the walls of said microchannels, coupled with the effects of the surface tension of said first drop, to an area in which it is brought into contact with a second drop of a second solution.

According to a preferential embodiment, this microfluidic method comprises a final step of merging said first drop and said second drop.

Advantageously, this microfluidic method also comprises the following steps:

- introduction of a second solution in microchannels of said microfluidic circuit;
- detachment of a second drop of said second solution in said carrier fluid, caused by the divergence of the walls of said microchannels, coupled with the effects of the surface tension of said second solution;
- displacement of said second drop, caused by the divergence of the walls of said microchannels, coupled with the effects of the surface tension of said second drop, to said area in which it is brought into contact with said first drop.

Advantageously, this microfluidic method is implemented in a microfluidic circuit as described above.

5. LIST OF FIGURES

The invention will be better understood in light of the following description of preferential embodiments, given for illustrative and nonlimiting purposes, and accompanied by figures in which.

6. DETAILED DESCRIPTION OF EMBODIMENTS

6.1. Microfluidic Circuit

Figure 1A:
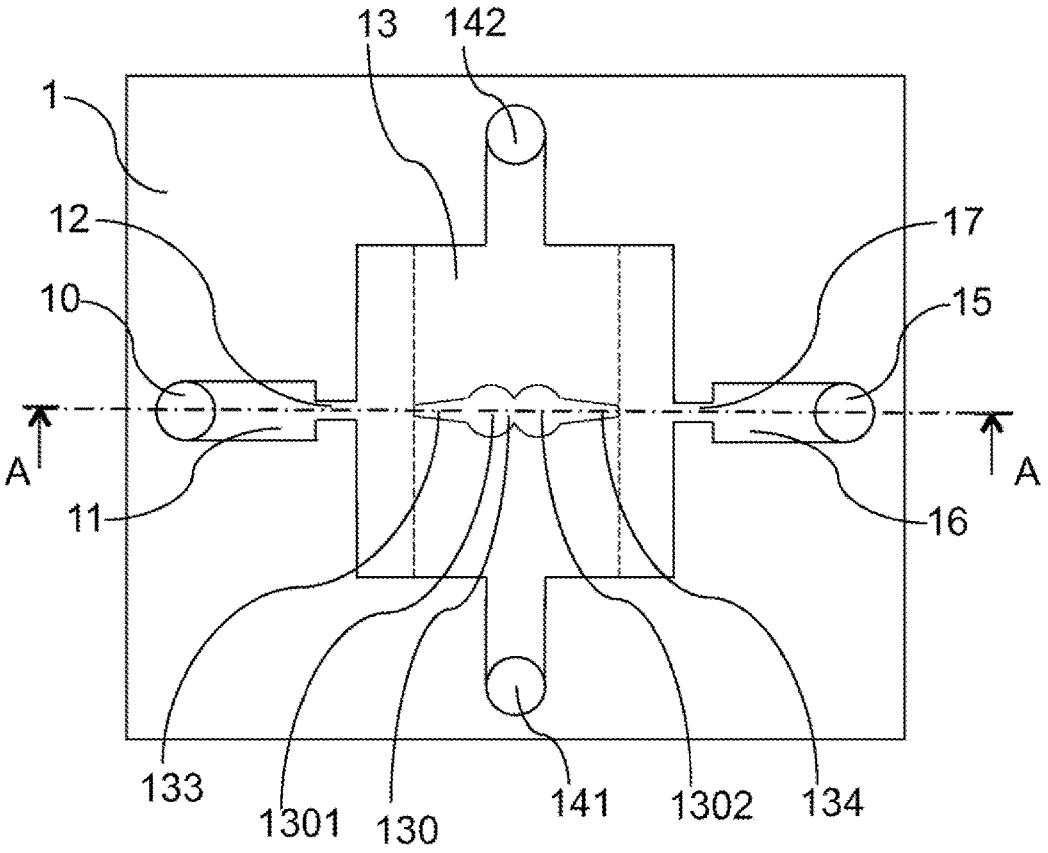
FIGS. 1A and 1B are respectively a plan and a cross-sectional view of a microfluidic circuit according to a first embodiment of the invention.

FIG. 1A is a plan, in plan view, of a microfluidic circuit 1 according to a first embodiment of the invention, making it possible to bring drops of several fluids into contact. This plan shows the different microfluidic channels which are formed inside this microfluidic circuit. This microfluidic circuit is also represented, in cross-sectional view, in FIG. 1B.

As is known per se, the microfluidic circuit may consist of two superposed plates, bonded to one another. Thus, the circuit 1 consists of a plate 102, which may for example be a transparent microscope slide, and a plate 101, of which the face in contact with the plate 102 is etched so as to define microchannels between the two plates, which are superposed and bonded to one another. The plate 101 may be made of a polymer material. Preferably, the material constituting at least one of the two plates is transparent, in order to facilitate the observation of the fluids in the microchannels. In this case, the observation of the circuit 1 makes it possible to see the microchannels through transparency, as represented by FIG. 1A.

As is known, the dimensions of these microchannels may be chosen freely by adapting the width and the depth of the etchings in the etched plate 101. For example, the microchannels may have a width of approximately 100 μm and a depth of approximately 50 μm. These microchannels may also have greater dimensions, or, on the contrary, smaller dimensions, so as to be adapted to the characteristics of different fluids, or to the sizes of the drops to be manipulated.

It should be noted that microfluidic circuits produced by other methods known to those skilled in the art may obviously be used to implement the invention. In some cases, these circuits may be called "dishes" or "tubes", rather than "microfluidic circuits". They do however constitute microfluidic circuits, within the meaning of the present invention, when the typical dimensions of the lines, or microchannels, which convey the fluids are between approximately 1 μm and 1 mm.

These microchannels are normally dimensioned in such a way that their walls exert a stress confining the solution or on the drops which circulate therein. In most microchannels, the drops are thus confined by the top, bottom, right and left walls. Some microchannels, hereinafter called "chambers", are however dimensioned in such a way as to exert a stress only in one dimension, two of their substantially parallel walls (generally the top wall and the bottom wall) being close to one another to confine the drops, and the other walls being sufficiently far apart to not confine the drops.

The microfluidic circuit 1 must, prior to its use, be filled with a fluid, hereinafter called carrier fluid, which is not miscible with the fluids that are to be manipulated in the circuit. This carrier fluid is for example oil, that may be added to a surfactant product making it possible to avoid the spontaneous merging of manipulated drops of fluid, if they come into contact. This surfactant additive may sometimes be unnecessary, notably if the aim is for the drops to merge spontaneously when they come into contact.

6.2. Formation of the Drops

The microfluidic circuit 1 comprises two feed holes 10 and 15, which are drilled in the plate 101, and into which the needle of a syringe or the end of a pipette may be introduced in order to inject therein the fluids that have to be manipulated. These feed holes 10 and 15 are linked respectively to feed channels 11 and 16 allowing each to convey the fluid to a drop forming nozzle, respectively 12 and 17.

These drop forming nozzles are microchannels of small section that may be fed with fluid by their first end and that pass this fluid in a controlled manner to a second end. FIGS. 2A, 3A, 4A and 5A represent the plan of the drop forming nozzle 12 in detail, at a number of moments in the formation of a drop of a fluid 2. This nozzle is also represented in detail by the cross-sectional views of FIGS. 2B, 3B, 4B and 5B, which correspond respectively to the views of FIGS. 2A, 3A, 4A and 5A. In the interests of clarity, the carrier fluid which fills the channels of the circuit 1 is not represented in these figures.

As these figures show, the second end of the nozzle 12 emerges on a central chamber 13, which has a top wall etched in the plate 101 and a bottom wall consisting of the plate 102. In proximity to the second end of the nozzle 12, the top wall of the chamber 13 has an inclined area 131, in such a way that the two walls of the chamber diverge when distanced away from the second end of the nozzle 12. This divergence of the walls allows the confinement to which the solution is subjected to decrease in its path, after its passage through the nozzle 12.

Figure 2A:
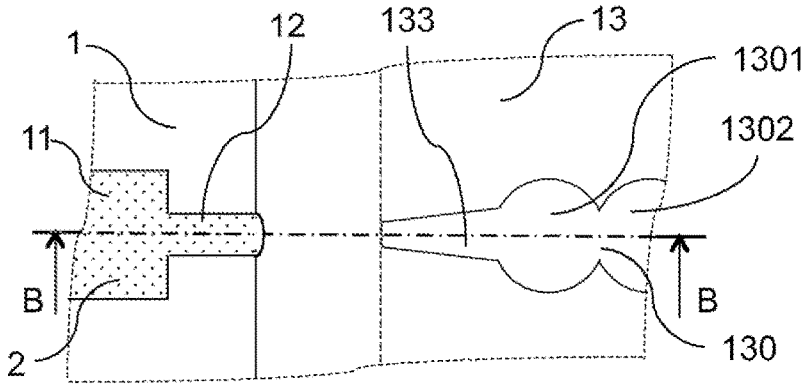
FIGS. 2A, 3A, 4A and 5A represent a detail of the plan of FIG. 1, at different moments in the use of the microfluidic circuit.
Figure 2B:
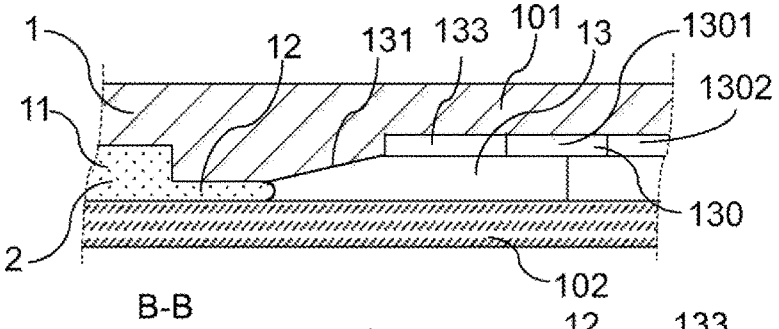
FIGS. 2B, 3B, 4B and 5B are cross-sectional views corresponding respectively to FIGS. 2A, 3A, 4A and 5A.
Figure 3A:
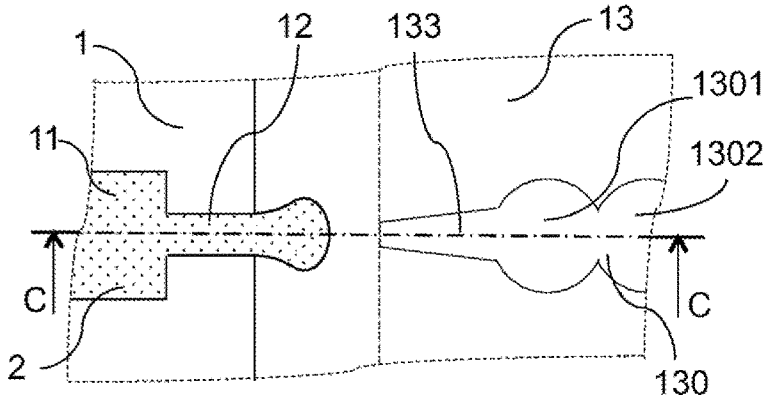
Figure 3B:
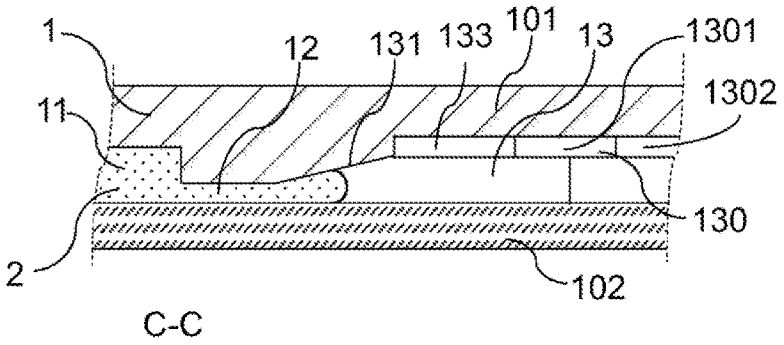

As FIGS. 2A and 2B show, when a fluid 2, for example a solution, is introduced into the microfluidic circuit 1 through the hole 10, it fills the feed duct 11 and the nozzle 12. When the introduction of the fluid into the hole 10 is continued, the leading edge of the fluid 2 advances in the chamber 13, as FIGS. 3A and 3B show. This fluid is then confined between a bottom wall, consisting of the plate 102, and a top wall, consisting of the inclined area 131, which diverge from one another on moving away from the nozzle 12.

Figure 4A:
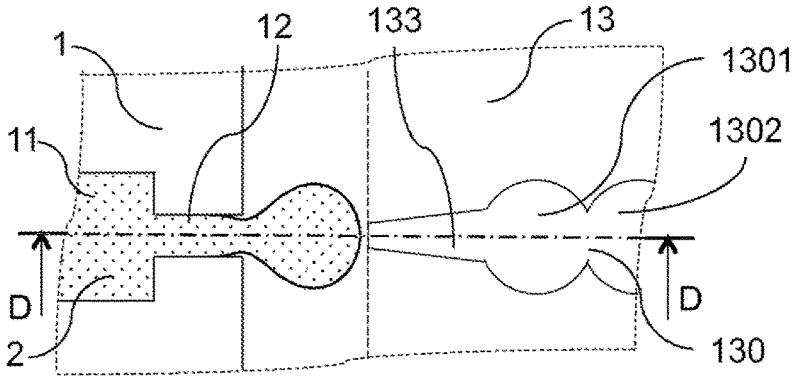
Figure 4B:
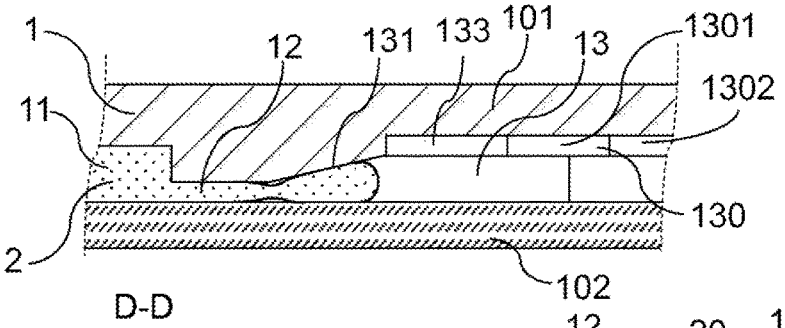
Figure 5A:
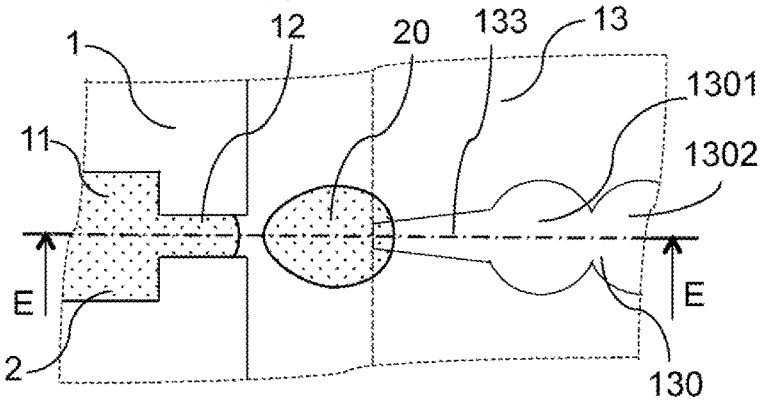
Figure 5B:
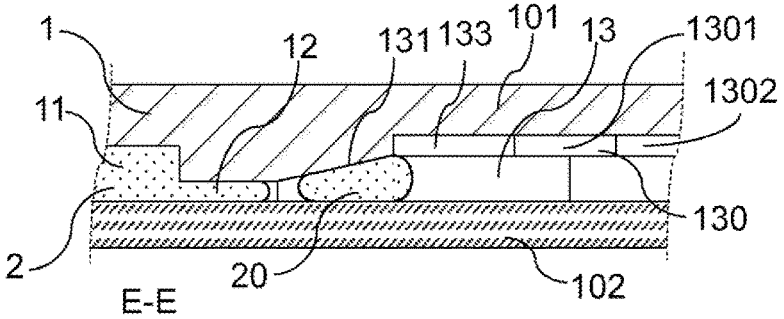

This divergence of the walls tends to attract the fluid 2 away from the nozzle 12. In effect, the fluid tends to assume a form as close as possible to a sphere, which is the form in which its surface energy is minimal. It tends therefore to be displaced towards spaces in which it is less confined. This attraction tends to separate the leading edge of the fluid from the nozzle 12 more rapidly than the fluid 2 arrives through the nozzle 12. As FIGS. 4A and 4B show, this separation tends to separate the leading edge of fluid 2 from the continuous flow of fluid 2 located in the feed duct 11 and the nozzle 12, until a drop 20 is separated from this continuous flow of fluid, as represented in FIGS. 5A and 5B.

Thus, the form of the microchannels of the microfluidic circuit 1, and more specifically the succession of a drop forming nozzle 12 and of a chamber 13 in which the walls diverge from one another on moving away from the nozzle 12, allows for the formation of drops 20 of fluid 2 without any flow of carrier fluid being necessary. The only action necessary to form these drops is in fact the introduction of the fluid 2 into the hole 10. It should be noted in this respect that the pressure of introduction of the fluid 2 into the microfluidic circuit 1 has only very little influence on the size of the drops 20 formed. It has thus been shown that a multiplication by a thousand of the pressure of introduction of the fluid 2 multiplies the size of the drop produced only by 2. The microfluidic circuit 1 therefore makes it possible to produce drops 20 of a size that devolves mainly from the geometrical characteristics of the microchannels (and notably the section of the nozzle 12 and the slope of the inclined area 131) and the viscosity of the fluid 2, and is consequently relatively uniform.

It should however be noted that, in certain cases, it is possible to exert stresses on the drops in formation to produce drops of different size. Thus, drops of larger size may be produced by injecting the fluid rapidly but for a short period. Similarly, drops of smaller size may be produced by sucking the fluid of the drop during the breakaway phase thereof These "active" forcing methods, in which an external intervention affects the formation of the drop, are not essential but may be used in conjunction with the passive methods described in the present application, in which the drops are formed naturally, under the effect of the form of the microchannels in which the fluids circulate and of the surface energy of these fluids.

Since the microfluidic circuit 1 is symmetrical, the feed duct 16 and the drop forming nozzle 17, associated with the inclined area 132 of the top wall of the chamber 13 in proximity to the nozzle 17, similarly make it possible to form drops 25 from the fluid which is introduced into the feed hole 15.

It should be noted that this drop forming method may advantageously be of the type described by the document WO2011/121220, in the name of the applicants.

6.3. Guiding of the Drops

Paths that make it possible to guide the drops are defined on the top wall of the chamber 13. These paths consist of grooves etched out of the wall. Thus, a drop placed in one of these paths may take a more compact form than a drop confined between the top and bottom walls of the chamber 13. As a consequence of this lesser confinement, a drop located in the path exhibits a lesser surface energy than a drop located to the side of this path. A drop placed in this path cannot therefore exit therefrom without an outside energy being applied to it.

More specifically, two guiding paths are provided in the chamber 13 of the microfluidic circuit 1. One guiding path 133 is formed in such a way that a first of its ends is placed in proximity to the place where the drops 20 are formed, such that these drops are engaged in the path after their formation. The edges of this path 133 are not parallel, and are further apart at its second end than at its first end. Thus, the top and bottom walls of the chamber 13 diverge from one another along this path, going from the first end to the second end of this path. Consequently, a drop 20 engaged in the path 133 at its first end is displaced toward its second end, under the effect of its surface tension, attracted by the configuration of the microchannel enabling it to take a form in which its surface energy is weaker.

Similarly, the guiding path 134 has a similar form, which enables it to collect, at its first end, the drops 25 being formed, and guide them toward its second end.

Very obviously, any other form of microchannels making it possible to guide the drops may be implemented without departing from the framework of the invention. It is also possible for the microfluidic circuit not to include any such path, only the slopes of the top and bottom walls of the chamber guiding the drops to their destination.

6.4. Trapping of the Drops

The second ends of the path 133 and 134 culminate at a storage area, or drop trap 130, situated in the middle of the chamber 13. The terms "storage area" or "trap" denote, in the present description, a space into which a drop may penetrate, but from which it cannot leave without outside intervention. This drop trap 130, which is defined by a hollowed etching in the top wall of the chamber 13, is advantageously in the form of an "eight" defining a trapping area 1301, which is connected to the second end of the path 133, and a trapping area 1302, which is connected to the second end of the path 134. Each of these trapping areas 1301 and 1302 has a configuration such that a drop which is placed therein cannot leave without external energy being applied to it.

It should be noted that the technique of guiding and trapping the drops in the microfluidic circuit may advantageously be of the type described by the document WO2011/039475, in the name of the applicants.

6.5. Bringing into Contact and Merging of the Drops

Figure 6A:
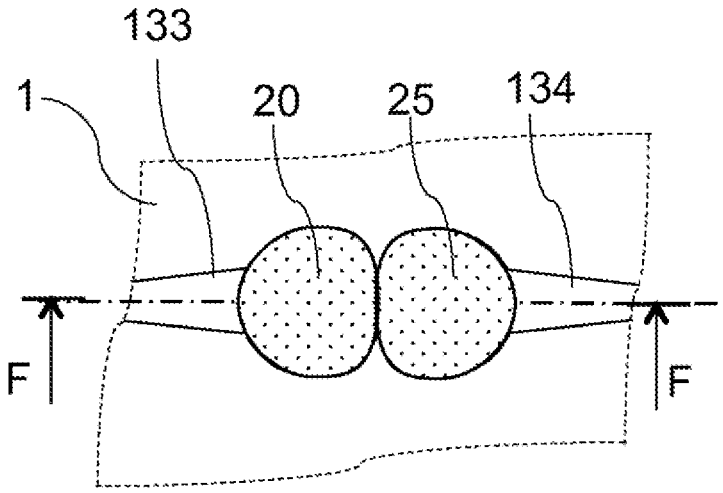
FIGS. 6A and 6B are respectively a plan and a cross-sectional view of another detail of the microfluidic circuit of FIG. 1, at a moment in its use.
Figure 6B:
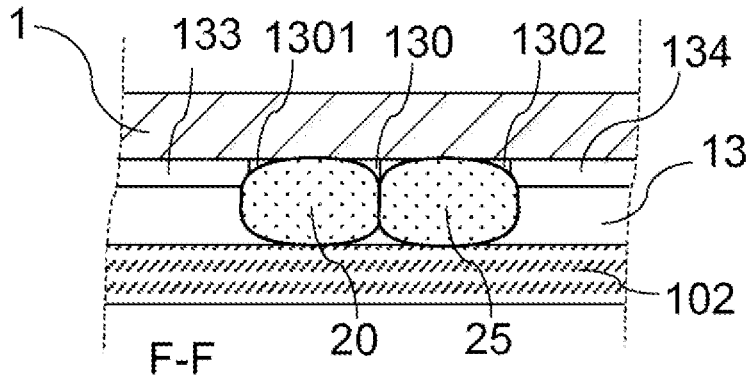

By introducing a first solution through the hole 10, and a second solution through the hole 15, it is possible to create a drop 20 of the first solution, which is guided until it is positioned in the trapping area 1301 and a drop 25 of the second solution, which is guided until it is positioned in the trapping area 1302 of the trap 130. When two drops 20 and 25 are placed, one in the trapping area 1301 and the other in the trapping area 1302, these two drops are in contact with one another, as FIGS. 6A and 6B show.

This contact of the drops does not however necessarily result in the contact of the solutions contained in each of the drops. In effect, each of the drops is entirely surrounded by a film of carrier fluid which separates the solutions from one another. However, the merging between the drops, by eliminating the film of carrier fluid separating the two drops 20 and 25 so that they do not form more than one drop, may be obtained easily, by using a technique known to those skilled in the art. This technique may, for example, be that described in the patent document FR 2 873 171, in the name of the applicant of the present application, in which a laser pulse is sent to the interface between two drops in order to provoke a local heating therein making it possible to break the film of carrier fluid between the two drops, and to merge them.

Other methods known to those skilled in the art may of course be implemented to merge the drops. Thus, it is known practice to produce a mechanical forcing of the merging, by applying a slight deformation of the chamber or vibrations, or to apply an electrical field triggering the merging of the drops, or to locally heat the interface between the drops.

In a microfluidic circuit according to the invention, it is also possible to provide for the merging of the drops to occur spontaneously after their contact. For this, it is sufficient to choose a carrier fluid exhibiting appropriate characteristics, for example an oil without surfactant additive. This variant is made possible by the microfluidic circuits according to the invention, in as much as they allow a drop to be able to come into contact only with the drop with which it will have to be merged.

Figure 6C:
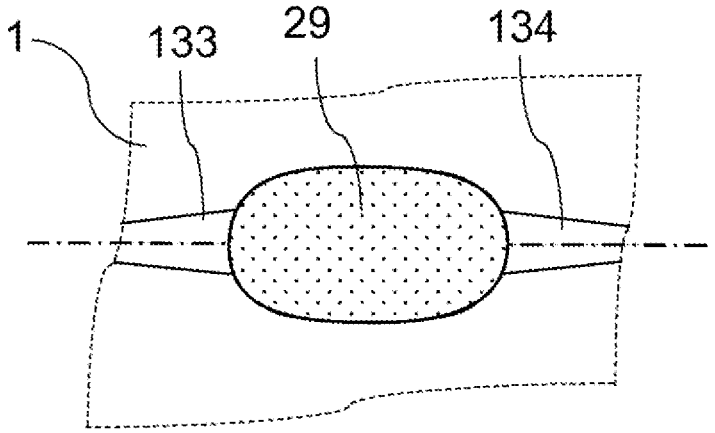
FIG. 6C is a plan of the detail of the microfluidic circuit represented by FIGS. 6A and 6B, at another moment in its use.

The merging of the drops culminates in the formation of a single drop 29 in the drop trap 130, as represented in FIG. 6C. As soon as the two drops 20 and 25 occupying the trapping areas 1301 and 1302 merge into a single drop occupying the trap 130, the solutions initially contained in the separate drops may react with one another. Since at least one of the walls of the microfluidic circuit 1 is transparent, it is then possible to provide an optical observation of the reaction taking place between the two solutions.

This observation is particularly easy, in the method according to the invention, by virtue of the fact that the trap 130, and its trapping areas 1301 and 1302, are in well defined positions. A suitable optical system may therefore be centered accurately on this trap 130. Because of the form of the drop trap 130, the drop 29 is advantageously oblong, which allows for a better observation of the progress of the reaction between the solutions contained in the two drops 20 and 25. Furthermore, the knowledge of the exact position of each of the solutions, at the moment when the merging occurs between the drops, and of the area where the contact is made between the two solutions, allows for an easier and more effective analysis of the observations.

6.6. Removal of the Drops

Once the reaction between the two solutions has taken place, it is possible to remove the drop from the trap 130, by injecting a flow of carrier fluid, with a sufficiently high pressure, through a hole 141 linked to the chamber 13. The flow of carrier fluid then passes through the chamber 13, and is discharged through the hole 142. This flow drives with it the drop placed in the trap 130, by imparting sufficient energy on it for it to leave the trap and be discharged from the chamber 13. The microfluidic circuit 1 may then be used again to observe a reaction of the same fluids, or, subject to the ducts and the drop forming nozzles being cleaned, of other fluids.

6.7. Embodiment Without Inclined Walls

A large number of variants of this microfluidic circuit may be implemented without departing from the framework of the invention, to be adapted to varied experimentation conditions.

Figure 7A:
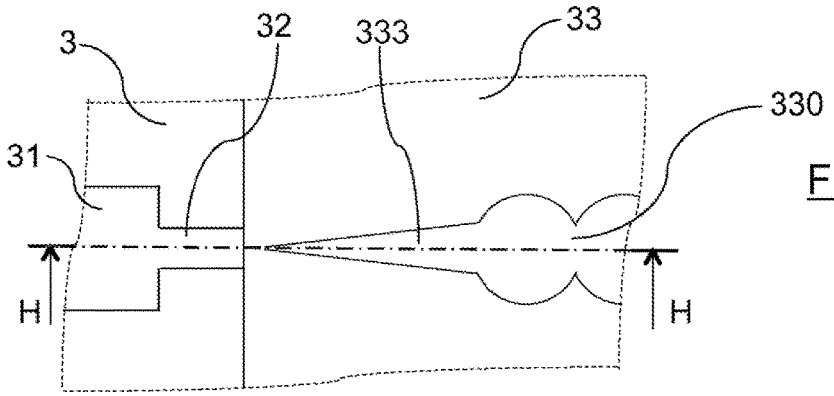
FIGS. 7A and 7B are respectively a plan and a cross-sectional view of a detail of a microfluidic circuit according to a second possible embodiment of the invention.
Figure 7B:
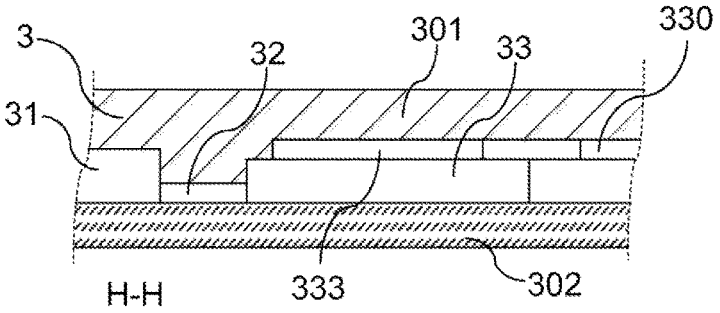

Thus, FIGS. 7A and 7B are respectively a plan and a cross-sectional view of a detail of a microfluidic circuit 3 according to a second possible embodiment of the invention.

Figure 1B:
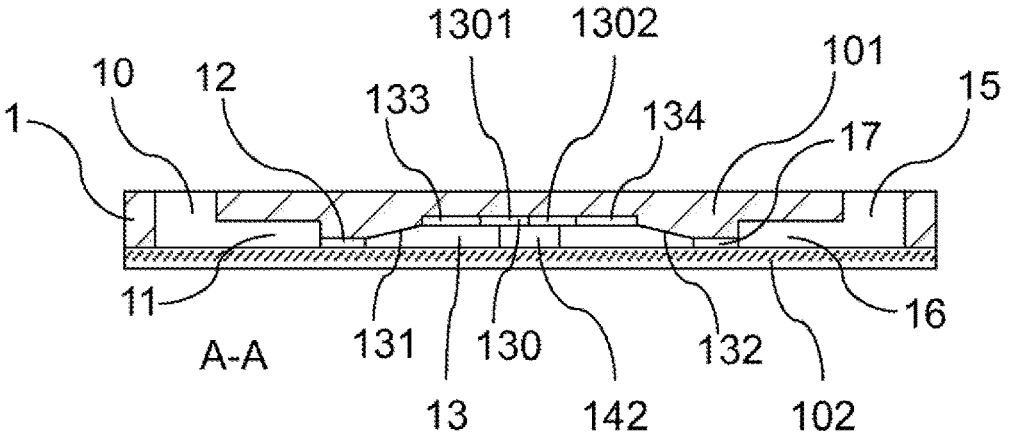

This microfluidic circuit 3 is largely identical to the microfluidic circuit 1 of FIGS. 1A and 1B. Only the central chamber 33 in which a drop forming nozzle 32 emerges, has a different configuration.

In effect, this central chamber 33 does not have inclined walls. On the other hand, the top and bottom walls of this central chamber 33 have a separation greater than that of the walls of the nozzle 32. Moreover, the guiding path 333, which makes it possible to drive a drop to the trap 330, is prolonged to close to the nozzle 32. The separation of the top and bottom walls of the central chamber 33, associated with the guiding path 333, makes it possible to detach drops of a solution passing through the nozzle 32 under the effect of the surface tension of this solution, in the same way as in the microfluidic circuit 1.

6.8. Embodiment with a Plurality of Trapping Area Feed Channels

Figure 8:
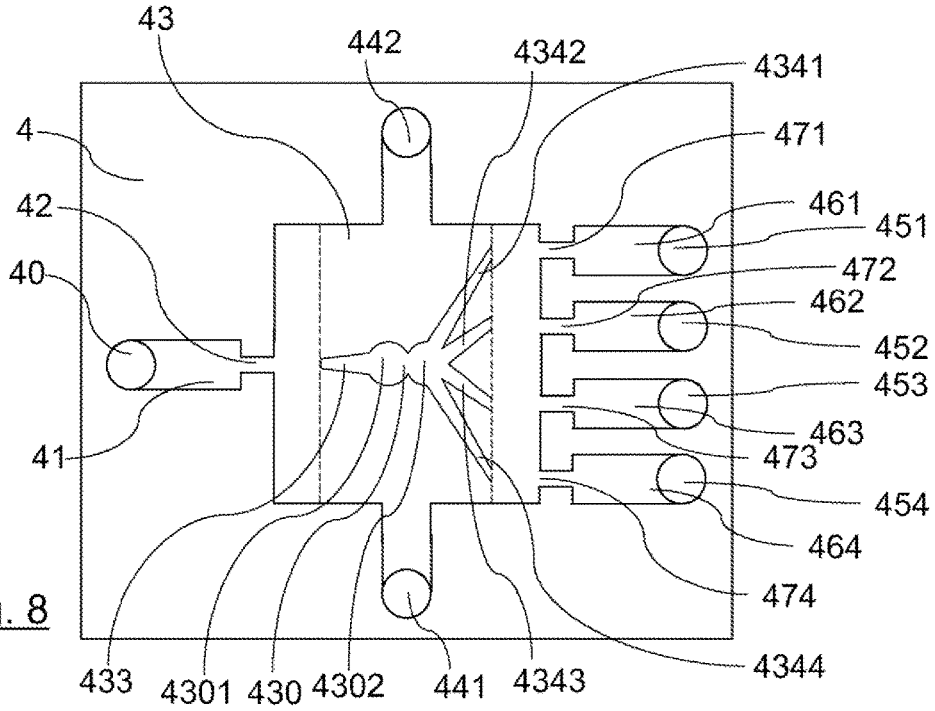
FIG. 8 is a plan of a microfluidic circuit according to a third possible embodiment of the invention.

FIG. 8 represents a plan of a microfluidic circuit 4 according to a third possible embodiment of the invention. One half of this microfluidic circuit 4 is identical to the microfluidic circuit 1 of FIGS. 1A and 1B. It thus comprises a feed hole 40 feeding a feed channel 41 and a drop forming nozzle 42, which emerges in a central chamber 43. The nozzle 42, in association with a suitable slope of the walls of the chamber 43 in proximity to the nozzle 42, allows the formation of drops of a fluid which is introduced into the hole 40. The drops that are formed are guided by a guiding path 433 to a first trapping area 4301 of a trap 430, situated substantially at the center of the chamber 43.

The second trapping area 4302 of the trap 430 is, for its part, connected to one end of a plurality of guiding paths 4341, 4342, 4343 and 4344. The other end of each of these guiding paths is situated in proximity to a drop forming nozzle, respectively 471, 472, 473, 474, which are each fed by a feed hole, respectively 451, 452, 453, 454, via a feed channel, respectively 461, 462, 463 and 464. Each drop forming nozzle 471, 172, 473, 473, in association with the appropriate slope of the walls of the chamber 43 in proximity to these nozzles, makes it possible to form drops with the solution which may be injected into the corresponding feed hole. This drop is then guided to the trapping area 4302 of the trap 430, in order to be able to be merged with a drop placed in the trapping area 4301.

Consequently, it is thus possible to merge a drop of a solution injected through the hole 40 with a solution injected, by choice, through one of the holes 451, 452, 453 or 454.

Such a microfluidic circuit makes it possible to perform, in succession, without having to clean the circuit, a plurality of chemical reactions between the solution introduced into the feed hole 40 and one of the solutions introduced into a feed hole chosen from the holes 451, 452, 453 or 454.

In practice, the feed circuit 4 makes it possible to simply produce reactions of a first solution with a plurality of other different solutions. The first solution may be injected into the hole 40 in order for a drop of this first solution to be placed in the trapping area 4301. A second solution may also be injected into the hole 451 in order to place a drop of this second solution in the trapping area 4302. The two drops may then be merged to provoke a reaction between the two solutions. After this reaction, it is possible to very easily discharge the drop resulting from the merging through the hole 442, by injecting a flow of carrier fluid through the hole 441.

It is then possible, without having to perform any additional cleaning, to again inject the first solution into the hole 40 to place a new drop thereof in the trapping area 4301, and to inject a third solution into the hole 452 in order to place a drop of this third solution in the trapping area 4302. A new reaction, between different solutions, may then be performed. Obviously, it is possible to continue the series of experiments by using the feed holes 453 and 454.

Obviously, the number of drop forming nozzles that may feed the trapping area 4302 may vary. Similarly, other variants of this microfluidic circuit may be devised by those skilled in the art, notably variants whereby each of the two trapping areas may receive drops originating from a plurality of drop forming nozzles, variants whereby one and the same guiding path may convey drops originating from a plurality of nozzles to one trapping area, and so on.

6.9. Embodiment with Drops of Different Sizes

Figure 9A:
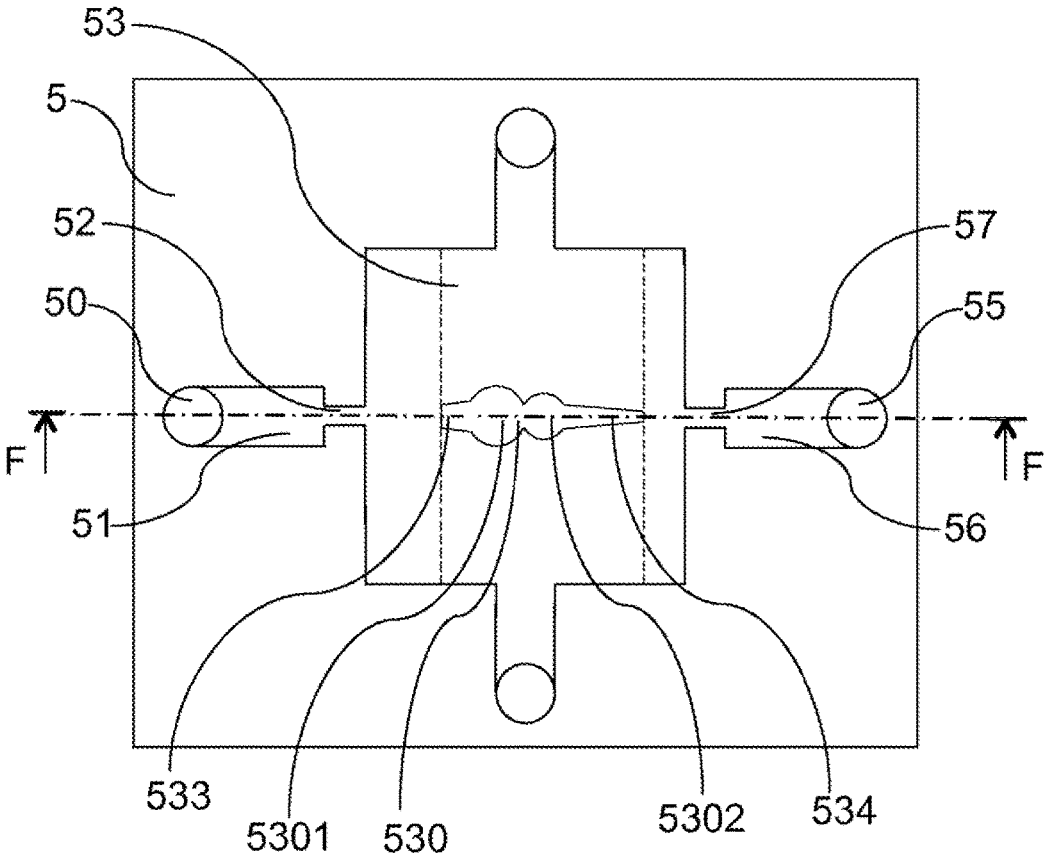
FIGS. 9A and 9B are respectively a plan and a cross-sectional view of a microfluidic circuit according to a fourth possible embodiment of the invention.
Figure 9B:
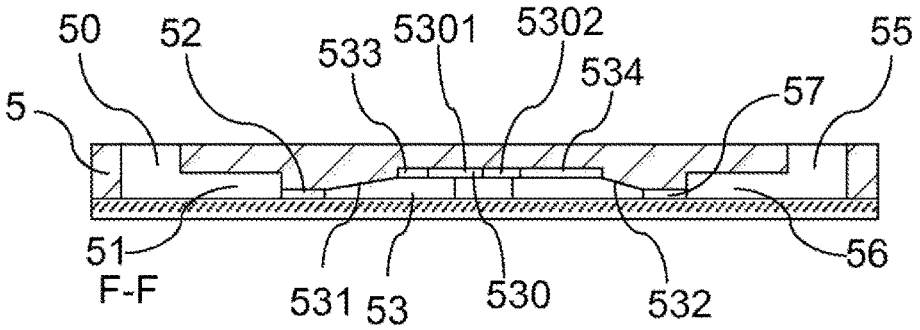

FIGS. 9A and 9B represent a microfluidic circuit 5 according to a fourth possible embodiment of the invention, making it possible to bring two drops of distinct solutions, having different volumes, into contact. To obtain drops of different volume, with a given fluid, it is possible to vary the dimensional characteristics of the microfluidic circuit, notably the dimensions of the nozzles and/or the slopes and/or separations of the walls at the outlet of the nozzles.

In the embodiment represented by the plan of FIG. 9A and the cross section of FIG. 9B, the microfluidic circuit 5 has feed holes 50 and 55, feed channels 51 and 56 and drop forming nozzles 52 and 57 which are identical to those of the circuit 1 represented by FIGS. 1A and 1B. On the other hand, the central chamber 53, at which the nozzles 52 and 57 emerge, have a form allowing the drops formed by the fluid passing through the nozzle 52 and the nozzle 57 not to be of the same size.

For this, the top wall of the chamber 53 has a first inclined area 531, in proximity to the nozzle 52, and a second inclined area 532, in proximity to the nozzle 57, the inclinations of which are not the same. Thus, the fluid exiting from the nozzle 52 is confined between two walls forming a relatively small angle, which means that the attraction of the fluid moving it away from the nozzle 52 is relatively weak. Consequently, when a drop ends up being detached from the flow of fluid, it has a relatively large volume. On the contrary, the fluid exiting from the nozzle 57 is confined between two walls forming a greater angle, which means that the attraction of the fluid moving it away from the nozzle 57 is stronger. Consequently, the drop is detached more rapidly from the flow of fluid, and has a relatively small volume.

The dimensions of the guiding paths 533 and 534, and of the trapping areas 5301 and 5302 of the trap 530 which are etched in one of the walls of the chamber 50 are preferably matched to the dimensions of the drops which have to circulate therein.

6.10. Embodiment Allowing Two Successive Contacts

Figure 10:
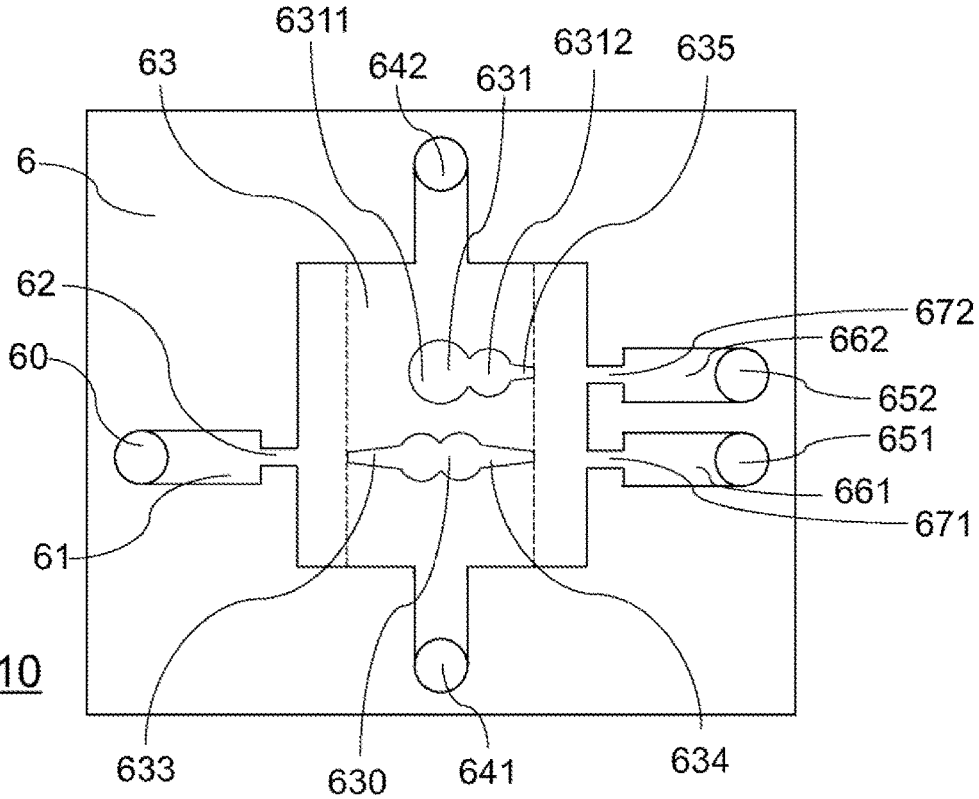
FIG. 10 is a plan of a microfluidic circuit according to a fifth possible embodiment of the invention.

FIG. 10 represents a plan of a microfluidic circuit 6 according to a fifth possible embodiment of the invention. This microfluidic circuit 6 is largely identical to the microfluidic circuit 1 of FIGS. 1A and 1B. It thus comprises a feed hole 60 feeding a feed channel 61 and a drop forming nozzle 62, which emerges in a central chamber 63. It also comprises a feed hole 651 feeding a feed channel 661 and a drop forming nozzle 671, which also emerges in the central chamber 63. The nozzles 62 and 671, in association with appropriate slopes of the walls of the chamber 63, each allow the formation of drops of a different solution. The drops formed are then guided by guiding paths 633 and 634 to a first trap 630, in which they may be brought into contact, then merged.

After this merging, it is possible to remove the drop resulting from the merging from the trap 630, by injecting a flow of carrier fluid, with a predetermined pressure, through a hole 641 linked to the chamber 63. A flow of carrier fluid then passes through the chamber 63, and is discharged through the hole 642 communicating with the chamber 3 at a position opposite the hole 641. This flow may communicate enough energy to the drop situated in the trap 630 for it to leave this trap and be displaced toward the hole 642.

This drop then arrives in the trapping area 6311 of a second trap 631 provided in the chamber 63. Preferably, the traps are configured for a flow of carrier fluid sufficient to cause the drop to exit from the trap 630 to be insufficient to cause the same drop to exit from the trapping area 6311. Thus, if the flow of carrier liquid is chosen shrewdly, the drop resulting from the merging of drops of the solutions introduced through the holes 60 and 651 is retained in the trapping area 6311.

This drop may then be brought into contact with a drop of a third solution, introduced into a feed hole 652 feeding a feed channel 662 and a drop forming nozzle 672, which emerges in the central chamber 63. This nozzle 672, in association with a suitable slope of the walls of the chamber 63, allows the formation of a drop of this third solution which is guided by a guiding path 635 to the trapping area 6312 of the second trap 631. The drops contained in the trapping areas 6311 and 6312 are then in contact, and may once again be merged.

Thus, the microfluidic circuit 6 allows a drop of a solution introduced through the hole 60 to be mixed in succession with a drop of a solution introduced through the hole 651 and with a drop of a solution introduced through the hole 651.

Figure 11:
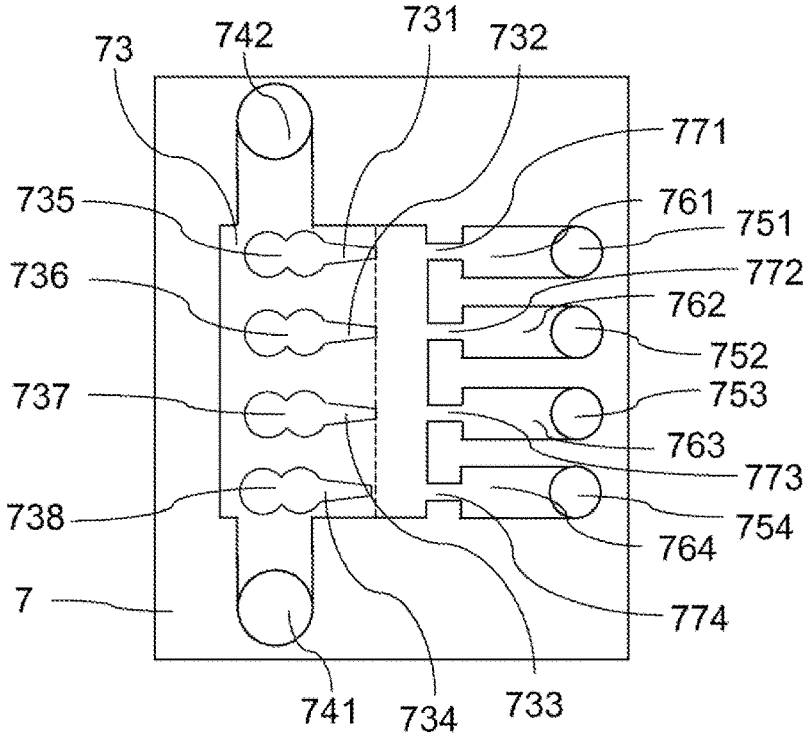
FIG. 11 is a plan of a microfluidic circuit according to a sixth possible embodiment of the invention.

6.11. Embodiment Allowing Drops of a First Solution to be Brought Into Contact With Other Different Solutions FIG. 11 represents a microfluidic circuit 7 according to a sixth possible embodiment of the invention.

This microfluidic circuit comprises a plurality of feed holes 751, 752, 753 and 754, which are respectively connected to feed channels 761, 762, 763 and 764, respectively feeding drop forming nozzles 771, 772, 773 and 774. Each of these nozzles 771, 772, 773 and 774 emerges at one and the same chamber 73, the walls of which have suitable slopes allowing the formation of drops of each of the solutions passing through the nozzles 771, 772, 773 and 774. These drops are each guided by a guiding path, respectively 731, 732, 733 and 734, to a trap, respectively 735, 736, 737 and 738.

Once each of the traps 735, 736, 737 and 738 contains a drop of a different solution, it is possible to bring into the chamber 73 a plurality of drops of another solution which are borne by a flow of carrier fluid introduced through the hole 741 and are discharged through the hole 742. Some of these drops are retained by the traps 735, 736, 737 and 738, in which they come into contact with the drops of the solutions introduced into the feed holes 751, 752, 753 and 754.

The microfluidic circuit according to this embodiment therefore makes it possible to bring into contact, in order to merge them, drops of a solution (introduced through the hole 741) with drops of a plurality of other solutions (introduced into the feed holes 751, 752, 753 and 754).

6.12. Embodiment with Round Central Chamber

Figure 12A:
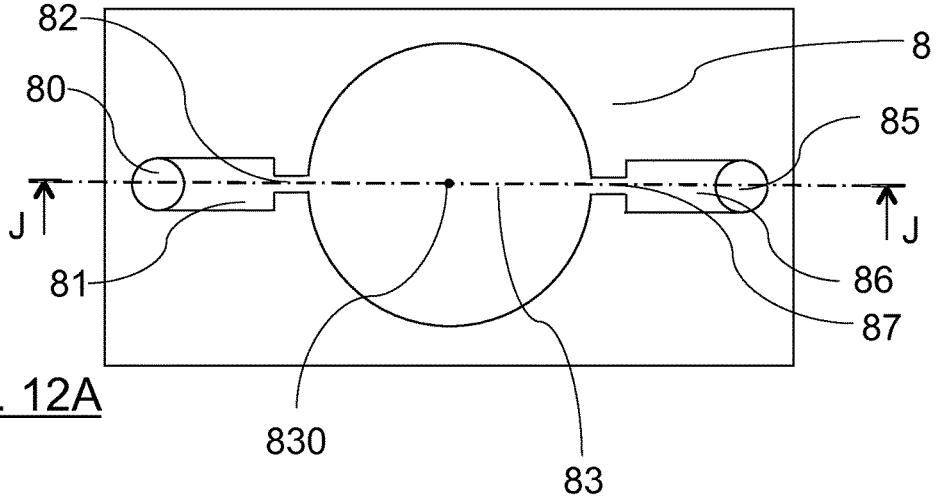
FIGS. 12A and 12B are respectively a plan and a cross-sectional view of a microfluidic circuit according to a seventh possible embodiment of the invention.
Figure 12B:
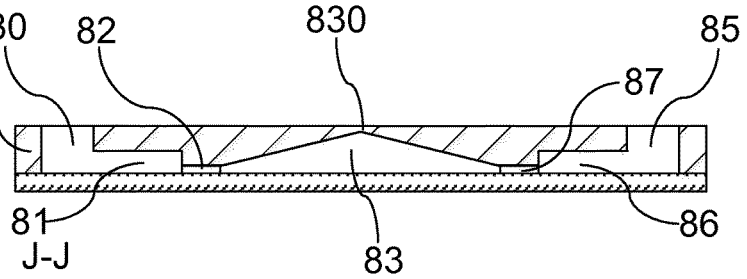

FIGS. 12A and 12B represent a microfluidic circuit 8 according to an eighth possible embodiment of the invention.

This microfluidic circuit 8 comprises a feed hole 80 feeding a feed channel 81 and a drop forming nozzle 82, which emerges in a central chamber 83. It also comprises a feed hole 85 feeding a feed channel 86 and a drop forming nozzle 87, which also emerges in the central chamber 83.

The central chamber 83 has, in this embodiment, a flat bottom wall and a cone-shaped top wall. The nozzles 82 and 87, in association with the slopes of the top walls of the central chamber 83, each allow the formation of drops of a different solution.

Because of this slope of the top wall of the central chamber 83, the drops that are thus produced are displaced, under the effect of the surface tension, toward the area situated in proximity to the apex 830 of the conical top surface. This central area of the chamber 83 constitutes a drop trap, in which the drops of the solutions introduced into the holes 80 and 85 come into contact, and may be merged.

This microfluidic circuit, in which the form of the chamber 83 is particularly simple, therefore allows drops of two distinct solutions to be brought into contact.

6.13. Embodiment with Parallel Drop Forming Nozzles

Figure 13:
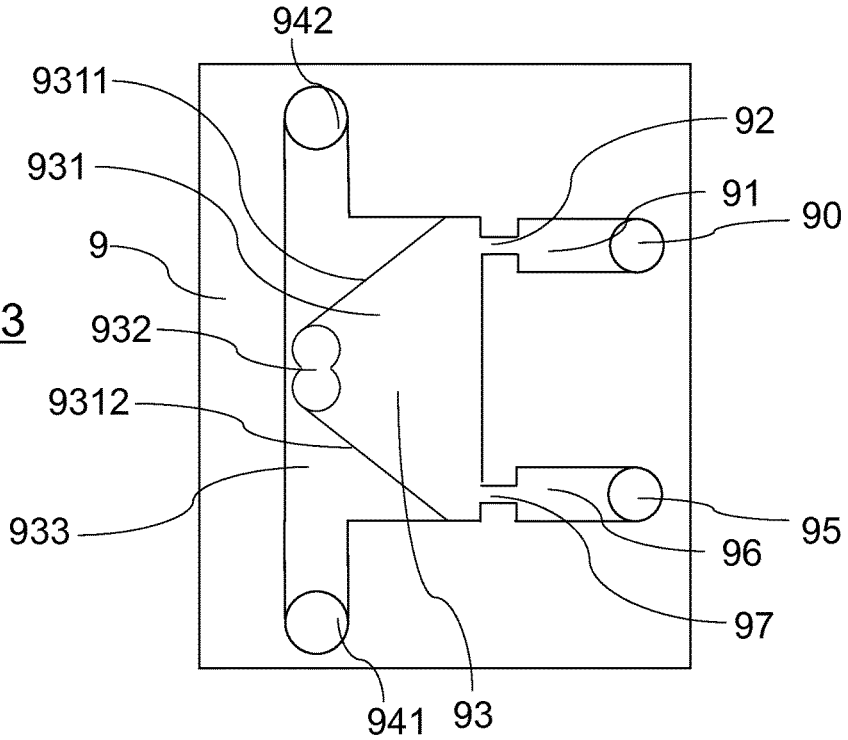
FIG. 13 is a plan of a microfluidic circuit according to an eighth possible embodiment of the invention.

FIG. 13 represents a microfluidic circuit 9 according to a ninth possible embodiment of the invention.

This microfluidic circuit 9 comprises a feed hole 90 feeding a feed channel 91 and a drop forming nozzle 92, which emerges in a central chamber 93. It also comprises a feed hole 95 feeding a feed channel 96 and a drop forming nozzle 97, which also emerges in the central chamber 93.

One of the walls of the central chamber 93 has, in this embodiment, a substantially triangular inclined area 931, which makes it possible for the bottom and top walls of the chamber to diverge on moving away from the nozzles 92 and 97 and toward a trap 932 provided in this chamber. The edges 9311 and 9312 of this inclined area 931, which separate it from a flat area 933 of the top wall of the chamber, are configured in such a way that a drop may not pass from the inclined area 931 to the flat area 933 without increasing its surface energy. Thus, the two drops produced in the chamber 93 are guided by the inclined area 931 to the trap 932 where they come into contact, and may be merged.

This microfluidic circuit therefore also allows drops of two distinct fluids to be brought into contact.

Obviously, a person skilled in the art may, without difficulty, devise other variants of such a microfluidic circuit, without departing from the framework of the invention.

The invention claimed is:

1. A microfluidic circuit, in which are defined microchannels containing fluids, said circuit comprising at least:

a first drop forming device configured to form drops of a first solution in a carrier fluid, comprising a first microchannel portion having walls passed through by said first solution; and a chamber comprising a storage area configured to trap one of said drops and bring said drop into contact with a drop of a second solution and a first guiding means configured to guide said drops formed by the first drop forming device to the storage area of the chamber, wherein the walls of said first microchannel portion of said first drop forming device diverge so as to detach drops of said first solution under the effect of the surface tension of said first solution, and said first guiding means comprise a second microchannel portion having walls that diverge so as to displace said drops under the effect of the surface tension of said first solution.

2. The microfluidic circuit according to claim 1, wherein said first drop forming device comprises a nozzle passed through by said first solution and emerging in the chamber, in which the walls of the chamber are further apart than walls of the nozzle.

3. The microfluidic circuit according to claim 2, wherein the walls of said chamber define said first guiding means and said storage area.

4. The microfluidic circuit according to claim 1, wherein an area of one of said microchannels is configured such that a drop may exhibit a lower surface energy than in the neighboring areas.

5. The microfluidic circuit according to claim 4, wherein said storage area consists of two contiguous trapping areas that may each receive a drop.

6. The microfluidic circuit according to claim 5, wherein said two contiguous trapping areas are two substantially circular trapping areas that partially intersect, so as to be in the form of an "8".

7. The microfluidic circuit according to claim 1, further comprising:

a second drop forming device configured to form drops of the second solution in said carrier fluid, comprising a third microchannel portion having walls passed through by said second solution, and a second guiding means configured to guide said drops formed by the second drop forming device to the storage area of the chamber, wherein one of said drops of said second solution may be brought into contact with said drop of the first solution, the walls of said third microchannel portion of said second drop forming device diverge so as to detach drops of said second solution under the effect of the surface tension of said second solution, and said second guiding means comprise a fourth microchannel portion having walls that diverge so as to displace the drops of said second solution under the effect of the surface tension of said second solution.

8. The microfluidic circuit according to claim 7, wherein an area of one of said microchannels is configured such that a drop may exhibit a lower surface energy than in the neighboring areas, said storage area consists of two contiguous trapping areas that may each receive a drop and said first guiding means are configured to guide the drops of said first solution to a first trapping area of said storage area, and said second guiding means are configured to guide the drops of said second solution to a second trapping area of said storage area.

9. The microfluidic circuit according to claim 7, wherein said first and second drop forming devices are configured to form drops of different sizes.

10. The microfluidic circuit according to claim 9, wherein an area of one of said microchannels is configured such that a drop may exhibit a lower surface energy than in the neighboring areas, said storage area consists of two contiguous trapping areas that may each receive a drop and said storage area has at least two trapping areas of different sizes, one being of a size suitable for receiving a drop formed by said first drop forming device, and the other being of a size suitable for receiving a drop formed by said second drop forming device.

11. The microfluidic circuit according to claim 8, further comprising a third drop forming device configured to form drops of a third solution in said carrier fluid, and third guiding means configured to guide said drops formed by the third drop forming device to the storage area of the chamber.

12. The microfluidic circuit according to claim 1, further comprising means for discharging drops situated in said storage area.

13. A microfluidic method for bringing two drops of different solutions into contact, comprising at least the following steps, performed simultaneously or in succession:

introducing a first solution in microchannels of the microfluidic circuit according to claim 1;

detaching a first drop of said first solution in a carrier fluid, caused by the divergence of the walls of said first microchannel portion, coupled with the effects of the surface tension of said first solution;

displacing said first drop, caused by the divergence of the walls of said second microchannel portion, coupled with the effects of the surface tension of said first drop, to the storage area; and trapping said first drop in said storage area.

14. The microfluidic method according to claim 13, further comprising the following steps:

introducing a second solution in microchannels of said microfluidic circuit;

detaching a second drop of said second solution in said carrier fluid, caused by the divergence of walls of a third microchannel portion, coupled with the effects of the surface tension of said second solution;

displacing said second drop, caused by the divergence of walls of a fourth microchannel portion, coupled with the effects of the surface tension of said second drop, to said storage area;

trapping said second drop in said storage area; and bringing into contact said second drop of the second solution with said first drop of the first solution.

15. The method according to claim 14 further comprising merging said second drop of the second solution with said first drop of the first solution as a final step.

* * * * *